US006845870B2

(12) United States Patent
Yang

(10) Patent No.: US 6,845,870 B2
(45) Date of Patent: Jan. 25, 2005

(54) TOWEL RACK

(76) Inventor: Chin-Wen Yang, No. 9, Lane 80, Hsing-An Rd., Sha-Lu Chen, Taichung Hsien (TW)

( * ) Notice: Subject to any disclaimer, the term of this patent is extended or adjusted under 35 U.S.C. 154(b) by 0 days.

(21) Appl. No.: 10/410,984

(22) Filed: Apr. 10, 2003

(65) Prior Publication Data

US 2004/0200792 A1 Oct. 14, 2004

(51) Int. Cl.[7] ..... A47F 5/08
(52) U.S. Cl. ..... 211/99; 211/104; 248/291.1
(58) Field of Search ..... 211/99, 100, 104, 211/170, 171; 248/291.1

(56) References Cited

U.S. PATENT DOCUMENTS 1,453,644 A * 5/1923 Tingle ..... 211/104
1,667,657 A * 4/1928 Dobert ..... 211/99
1,767,545 A * 6/1930 Mossbacher ..... 211/106
2,200,411 A * 5/1940 Boye ..... 248/265
2,217,795 A * 10/1940 James et al. ..... 211/100
2,545,996 A * 3/1951 James ..... 211/104
2,615,579 A * 10/1952 Sampson ..... 211/100
3,044,674 A * 7/1962 Levy ..... 224/42.34
6,726,036 B2 * 4/2004 Koellner ..... 211/104

* cited by examiner

*Primary Examiner*—Robert W. Gibson, Jr.
(74) *Attorney, Agent, or Firm*—Jackson Walker LLP

(57) ABSTRACT

Towel rack has a mounting bracket, a hanging rod assembly and a pivot pin. The mounting bracket has multiple limits defined on the mounting bracket. The hanging rod assembly is pivotally attached to the mounting bracket and is curved. When users use the towel rack, towels and clothes hangers will not touch the wall because of the curved hanging rod assembly. When the towel is not being used, the towel rack can be folded against the wall to decrease the total volume and easily stored.

3 Claims, 5 Drawing Sheets

TOWEL RACK

BACKGROUND OF THE INVENTION

1. Field of the Invention

The present invention relates to a towel rack, and more particularly to a towel rack on which a practical quantity of clothes or towels can be hung conveniently and can be folded to occupy a minimum space occupation.

2. Description of the Related Art

A conventional towel rack is usually mounted in a bathroom to hang towels or clothes but has the following shortcomings:

1. The conventional towel rack has a specific length that limits the quantity of towels that can be hung on the towel rack to an impractical amount;
2. The width of the conventional towel rack is limited and does not allow clothes hangers to be hung freely on the towel rack since the clothes hangers will touch the wall and hang at an awkward angle that may cause the clothes to fall off the hangers; and
3. The conventional towel rack cannot be folded so the volume of the conventional towel rail is reduced to save space.

A towel rack in accordance with the present invention obviates or mitigates the aforementioned problems.

SUMMARY OF THE INVENTION

The primary objective of the towel rack in accordance with the present invention is to provide a towel rack having a large area on which towels and clothes can be hung, and yet can be easily stored.

To achieve the objective, the towel rack in accordance with the present invention has a mounting bracket, a hanging rod assembly and a pivot pin. The mounting bracket is attached to a wall and has multiple protruding pieces formed on the base. The hanging rod is attached pivotally to the base and is curved. The pivot pin is screwed through the mounting bracket and the hanging rod.

When the users use the towel rack in accordance with the present invention, towels and clothes hangers will not touch the wall because the hanging rod is curved away from the wall. When the towel rack is not being used, the towel rack folds against the wall to decrease the total volume.

Other objectives, advantages and novel features of the invention will become more apparent from the following detailed description when taken in conjunction with the accompanying drawings.

DETAILED DESCRIPTION OF THE INVENTION

Figure 1:
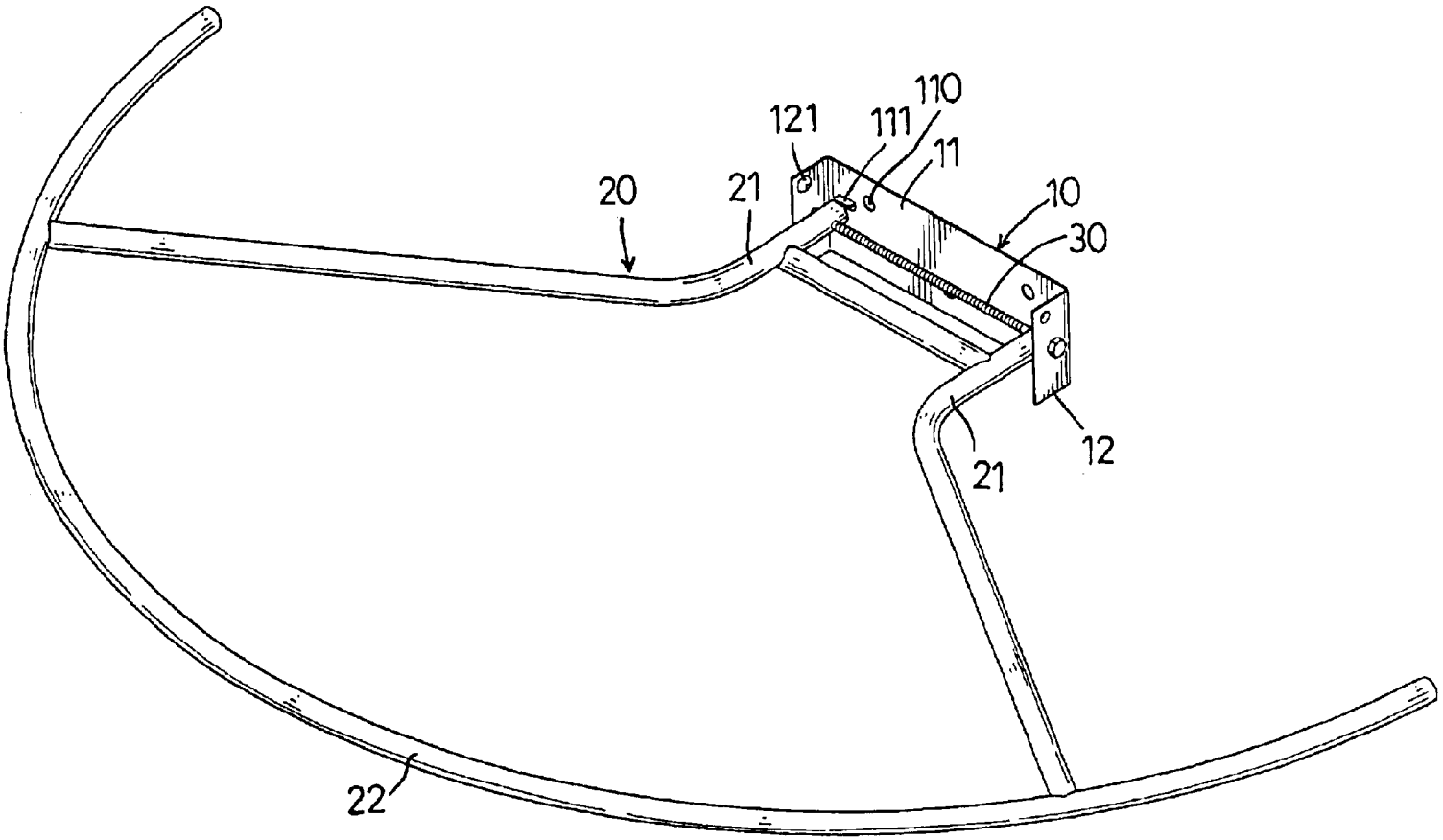
FIG. 1 is a perspective view of a towel rack in accordance with the present invention.
Figure 2:
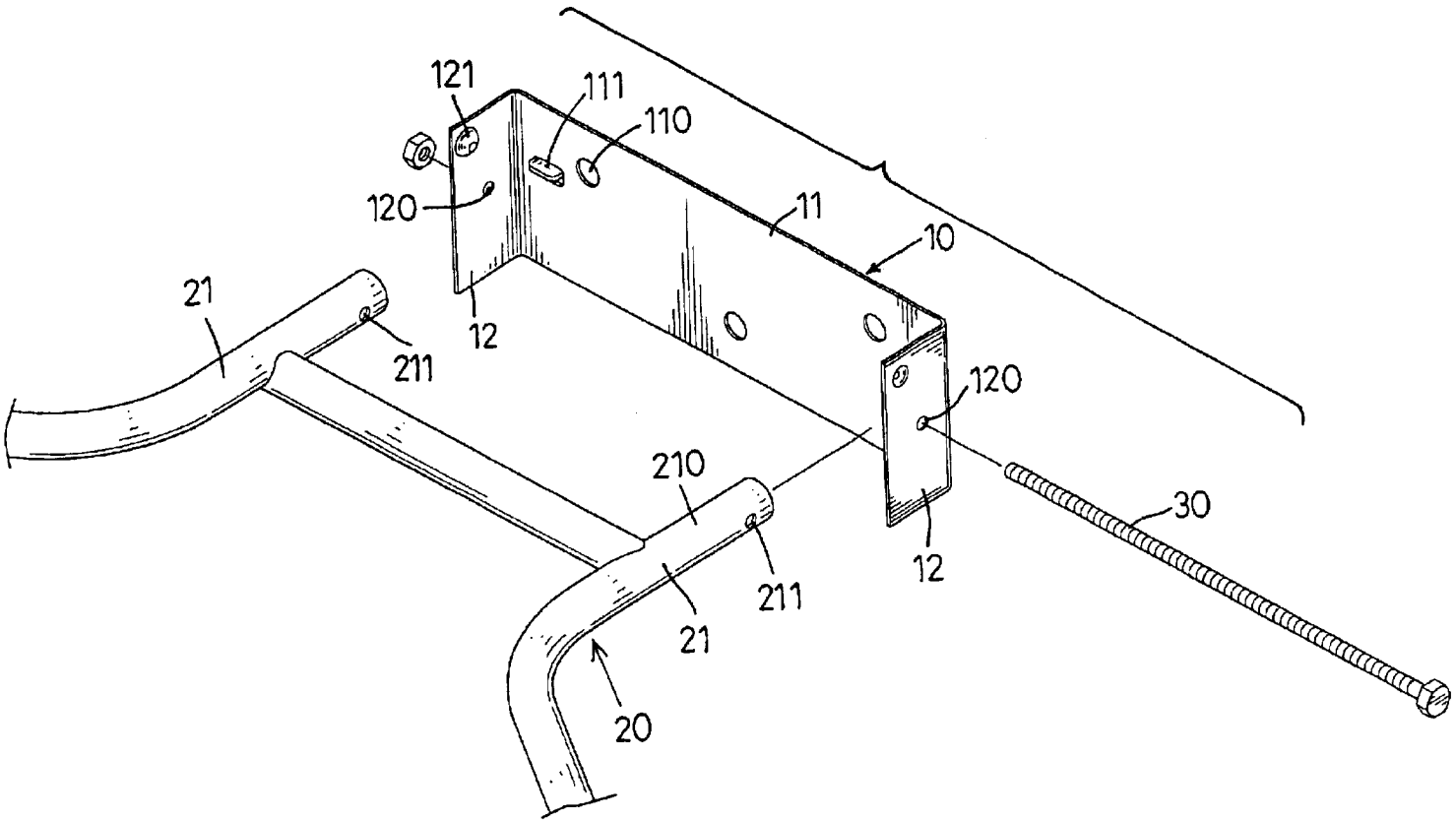
FIG. 2 is an enlarged exploded partial perspective view of the towel rack in FIG. 1.

With reference to FIGS. 1 and 2, a towel rack in accordance with the present invention comprises a mounting bracket (10), a hanging rod assembly (20) and a pivot pin (30).

The mounting bracket (10) is U-shaped and has a body (11), two wings (12), two domed protrusions (121), multiple mounting holes (110) and multiple limits (111). The body (11) has a length (not numbered), a top edge (not numbered), a bottom edge (not numbered), two parallel ends (not numbered) and an inside surface (not numbered. The wings (12) are integrally formed respectively with the parallel ends of the body (11), extend parallel to each other from the inside surface and respectively have a through hole (120). The through holes (120) are aligned with each other. The domed protrusions (121) are respectively formed on the wings (12) near the top edge, and the domed protrusions (121) are aligned with each other. Multiple mounting holes (110) are defined through the body (11). The limits (111) are formed on the inside surface of the body (11) and are arranged in a line slightly above the through holes (120) in the wings (12).

The hanging rod assembly (20) has two bent support rods (21), a cross member (not numbered) and a hanging rod (22). Each bent support rod (21) has a short portion (210) and a long portion (not numbered). The short portions (210) of the bent support rods (21) are parallel to each other, and each short portion (210) has an inner end (not numbered) and a transverse hole (211). The inner ends correspond respectively to the limits (111) on the body (10). The transverse holes (211) are defined respectively through the short portions (210) near the inner ends and are aligned respectively with the through holes (120) in the wings (12). The long portions of the bent support rods (21) obliquely extended from the short portion (210), and each long portion has a distal end (not numbered). The cross member is securely attached between the short portions (210) of the bent support rods (21). The arm hanging rod (22) is arcuate and has an inside surface securely attached to the distal ends of the long portions of the support rods (21).

The pivot pin (30) is a threaded pin and is longer than the length of the mounting bracket (10).

Figure 3:
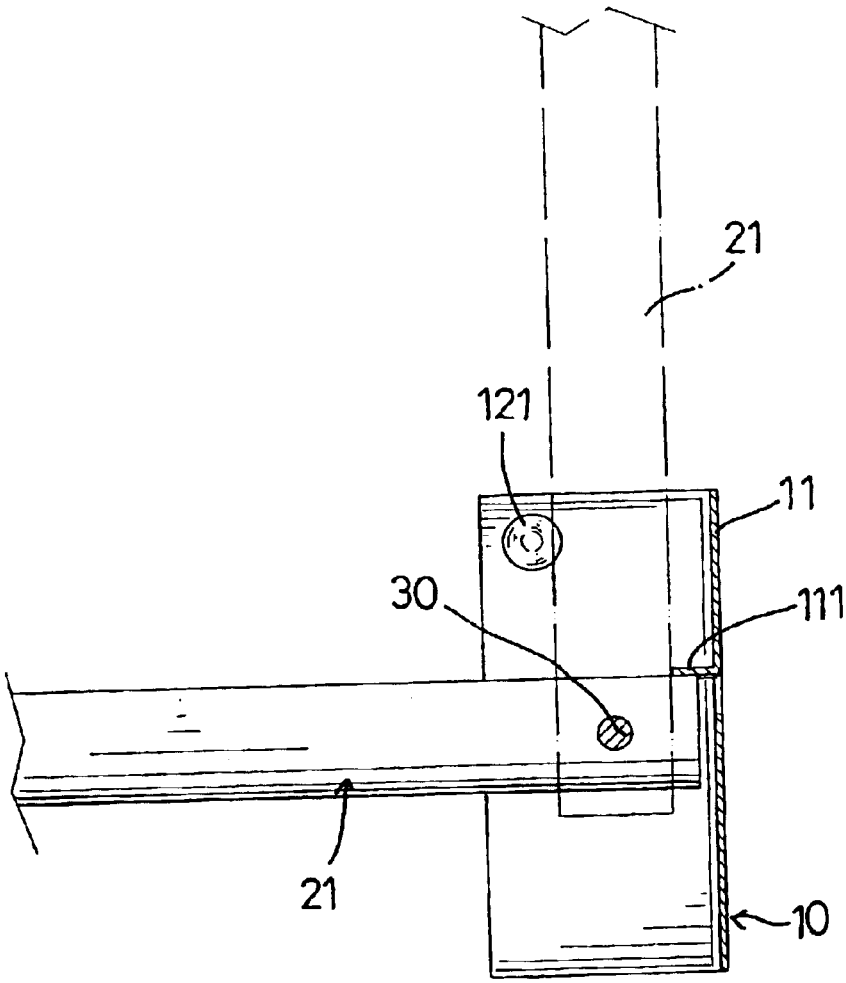
FIG. 3 is an enlarged partial side view of the towel rack in FIG. 1.

With reference to FIGS. 1 and 3, the pin (30) extends through the transverse holes (211) in the short portions (211) of the bent support rods (21) and the pivoting holes (120) in the wings (12) of the mounting bracket (10) and is held in place with a nut (not numbered), such that the hanging rod assembly (20) is pivotally attached to the inside surface of the mounting bracket (10) with the pin (30). When the hanging rod assembly (20) is lowered so that it is perpendicular to the body (11) and a wall to which the body is mounted, the ends of the short portions (210) of the bent support rods (21) abut the limits (111). With the abutment between the short portions (210) of the bent support rods (21) and the limits (111), the hanging rod assembly (20) will be kept a substantially horizontal position so that clothes hangers or towels can be hung on the hanging rod assembly (20) as shown in FIG. 5.

Figure 4:
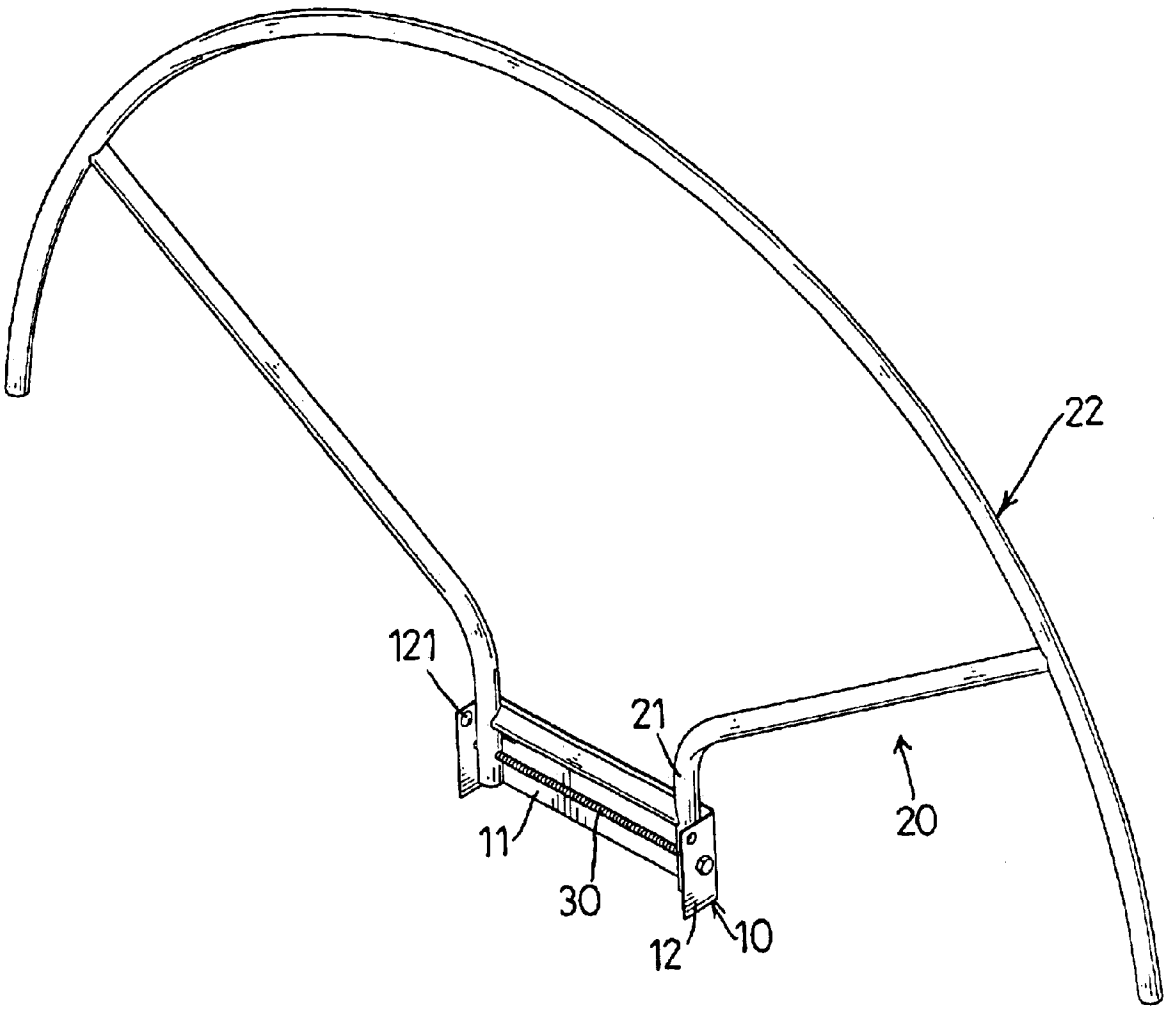
FIG. 4 is an operational perspective view of the towel rack in FIG. 1.

With reference to FIGS. 3 and 4, when the hanging rod assembly (20) is raised to be substantially parallel to the body (11) of the mounting bracket (10) and the wall, the short portions (210) are pressed passed the domed protrusions (111), and the hanging rod assembly (20) is held in a vertical position by the domed protrusions (121). Accordingly, the towel rack in accordance with the present invention can occupy a minimum space.

Figure 5:
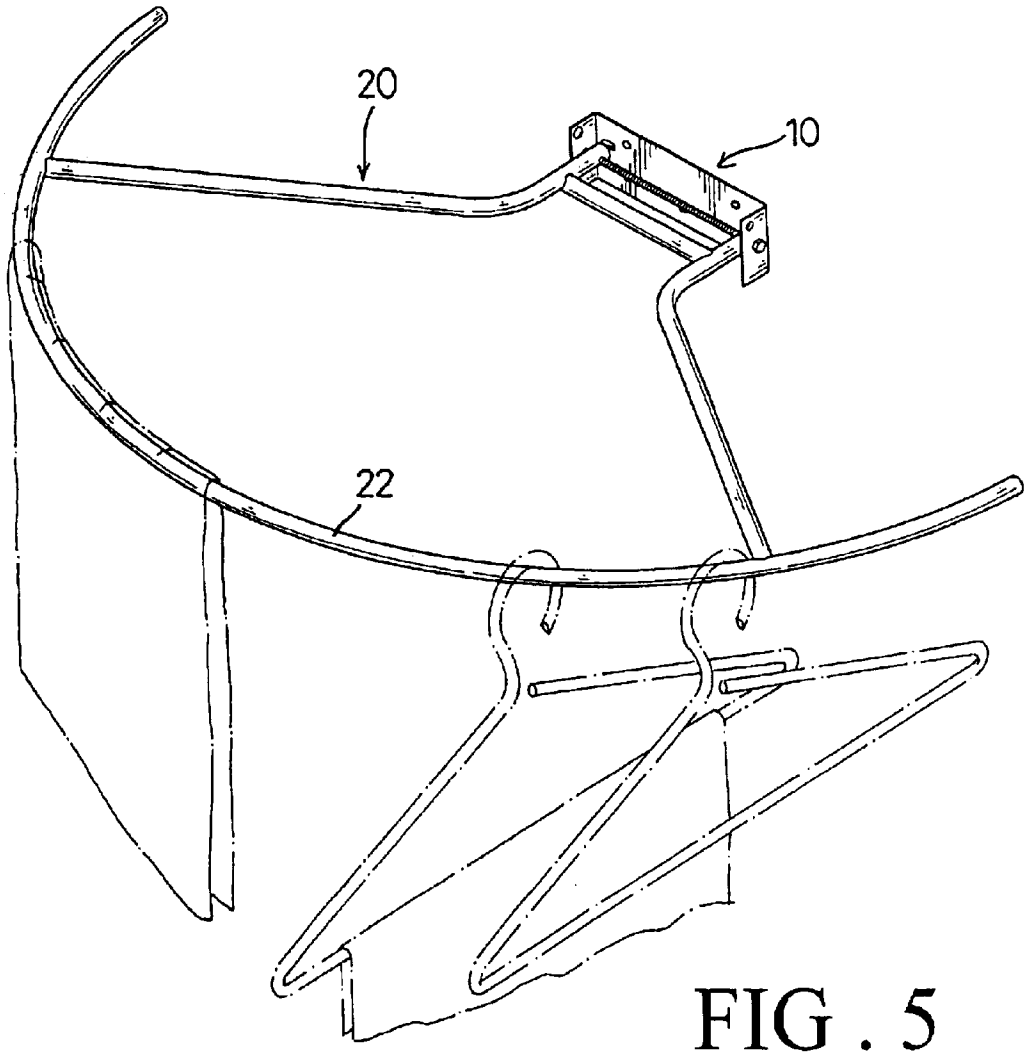
FIG. 5 is an operational perspective view of the towel rack in FIG. 1 when the towel is extended to hang towels and clothes hangers.

With reference to FIG. 5, the hanging rod (22) of the towel rack in accordance with the present invention is larger than the conventional one to hang many towels and clothes hangers mounted hung, and the hanging rod (22) is curved so the clothes hangers hung on the hanging rod (22) do not touch the wall. Accordingly, the towel rack in accordance with the present invention can accommodate a practical quantity of clothes hangers or towels.

The invention may be varied in many ways by a person skilled in the art. Such variations are not to be regarded as a departure from the spirit and scope of the invention, and all such modifications are intended to be included within the scope of the following claims.

What is claimed is:

1. A towel rack comprising a mounting bracket, a hanging rod assembly and a pivot pin;

the mounting bracket having a body having a length, a top edge, a bottom edge, two parallel ends and an inside surface;

two wings integrally formed with the two parallel ends of the body, extending parallel to each other from the inside surface and respectively having a through hole, wherein the through holes are aligned with each other;

a domed protrusion formed on each respective wing near the top edge, wherein the dome protrusions are aligned with each other;

multiple mounting holes are defined through the body; and multiple limits are formed on the inside surface of the body in a line slightly above the through holes in the wings;

the hanging rod assembly pivotally attached to the mounting bracket by the pivot pin and having two bent support rods, each having a short portion with an inner end corresponding to one of the limits on the body and a transverse hole defined near the inner end said transverse holes being aligned with the through holes in the wings; and a long portion obliquely extending from the short portion and having a distal end;

a cross member securely attached between the short portions of the bent support rods; and a hanging rod securely attached to the distal ends of the long portions; and the pivot pin extending through the two wings and the short portions of the bent support rods, wherein the free end of the short portion of each bent support rod abuts the corresponding limit when the hanging rod assembly is lowered relative to the mounting bracket, and the hanging rod being held in place by the domed protrusions on the wings of the mounting bracket when the hanging rod assembly is raised relative to the mounting bracket.

2. The towel rack claimed in claim 1, wherein the hanging rod is curved.

3. The towel rack claimed in claim 1, wherein the pivot pin extends through the through holes in the wings and the transverse holes in the short portions of the bent support rods to pivotally attached the hanging rod assembly to the mounting bracket and the pivot pin is held in place by a nut screwed onto the pivot pin.

* * * * *